US007562852B2

(12) United States Patent
Wang

(10) Patent No.: US 7,562,852 B2
(45) Date of Patent: Jul. 21, 2009

(54) KEYBOARD SUPPORT

(75) Inventor: Chia-Ming Wang, Shenkeng Township, Taipei County (TW)

(73) Assignee: Sallas Industrial Co., Ltd., Taipei County (TW)

( * ) Notice: Subject to any disclaimer, the term of this patent is extended or adjusted under 35 U.S.C. 154(b) by 297 days.

(21) Appl. No.: 11/653,215

(22) Filed: Jan. 16, 2007

(65) Prior Publication Data

US 2008/0006754 A1 Jan. 10, 2008

(30) Foreign Application Priority Data

Jul. 4, 2006 (TW) ..... 95124308 A

(51) Int. Cl.
*E04G 3/00* (2006.01)

(52) U.S. Cl. ..... 248/285.1; 248/284.1; 248/118.5; 248/280.11; 248/278.1; 108/140; 108/48; 84/174

(58) Field of Classification Search ..... 248/276.1, 248/278.1, 279.7, 281.11, 285.11, 285.1, 248/286.1, 918
See application file for complete search history.

(56) References Cited

U.S. PATENT DOCUMENTS 5,096,151 A * 3/1992 Shemitz et al. ..... 248/285.1
5,127,617 A * 7/1992 Bergetz ..... 248/278.1
5,839,373 A * 11/1998 Lin ..... 108/140
6,012,693 A * 1/2000 Voeller et al. ..... 248/280.11
6,042,064 A * 3/2000 Hong ..... 248/118.5
6,592,090 B1 * 7/2003 Li ..... 248/284.1
6,905,102 B2 * 6/2005 Lin ..... 248/285.1
7,048,242 B2 * 5/2006 Oddsen, Jr. ..... 248/280.11
7,188,813 B2 * 3/2007 Kollar ..... 248/279.1
2005/0188812 A1 * 9/2005 Wang ..... 84/174

* cited by examiner

*Primary Examiner*—J. Allen Shriver, II
*Assistant Examiner*—Erin Smith
(74) *Attorney, Agent, or Firm*—Rosenberg, Klein & Lee

(57) ABSTRACT

A keyboard support comprises a platform for supporting a keyboard, a bracket placed on a predetermined position for locking and stabling the platform by a lock module, a joint module connected with an end of the bracket to be used for adjusting the up/down angle of the bracket, a sleeve having a closed end connected to the joint nodule, a crooked shaft having a end slipped over a opened end of the sleeve to be used for adjusting the waving angle of the platform by rotating the sleeve, and a base used for fastening another end of the crooked shaft to an object, wherein the crooked shaft can be rotated for adjusting the position thereof, thus, the adaptability of the support can be improved for various free-angle and positions adjustment according to the coordination of the joint module, the sleeve, the crooked shaft, and the base.

16 Claims, 9 Drawing Sheets

KEYBOARD SUPPORT

FIELD OF THE INVENTION

The present invention relates to a keyboard support, and more particularly to a support with adjusting various free angle and positions, such that can improve the adaptability.

BACKGROUND OF THE INVENTION

Due to the progress of the industrial technology, a lot of human operations are replaced by computer gradually, such that most of manufactories have industrial computers inside for automation operation. However, in accordance with the space of manufactories is very expensive, the space of industrial computers is required to utilize efficiently, as well as, the personal computer requires the same surely. Accordingly, a keyboard support designed to be used with computers can be convenient for users, and be easily for storage.

Referring to FIG. 1A, is a prior art keyboard support. The support comprises a platform 15, a first stationary configuration 11, and a supporting member 13, wherein the supporting member 13 is connected and linked a bearing 133 and a socket base 131. The first stationary configuration 11 can be slipped over the socket base 131 through a shaft 111, and welded with the platform 15 through a connected wing plate 113.

Referring to FIG. 1B and FIG. 1C, are respectively as operation views of prior art keyboard support. Users can adjust the up/down angle of the platform 15 according to rotate the platform 15, which follows the first stationary configuration 11 and regards the first axis 135 of the bearing 133 as the origin point, as well as, the second axis 137 of the socket base 131 can be also as the origin point to be used for position adjustment in right and left directions.

However, although the support 10 can be used for adjusting the platform 15 with up/down angle, and right and left positions, but the platform 15 would be tilted when the platform 15 is adjusting in up/down angle, and further adjusting in right and left positions at next, such that is not convenient for users. Thus, the adjustment is surely without any sense.

SUMMARY OF THE INVENTION

It is a primary object of the present invention to provide a keyboard support, comprising a crooked shaft used to slip over a sleeve, wherein the crooked shaft can be as the axis for rotating to adjust the moving angle of the support.

It is a secondary object of the present invention to provide a keyboard support, comprising a crooked shaft and a sleeve, wherein the crooked shaft and the sleeve further comprise a limiting member for limiting the range of rotating and shifting, such that can improve the stability as adjusting the support.

It is another object of the present invention to provide a keyboard support, comprising a joint module for adjusting the up/down angle of the platform, such that can increase the convenience for users.

It is another object of the present invention to provide a keyboard support, comprising a joint module, wherein the joint module further comprises a limiting member for limiting the range of up/down angle thereof, such that can improve the stability as adjusting.

It is another object of the present invention to provide a keyboard support, comprising a bracket, which can be as a slide guide for adjusting the short and long positions.

It is another object of the present invention to provide a keyboard support, comprising a crooked shaft transpierced on the base thereof for slipping over other devices.

To achieve the previous mentioned objects, the present invention provides a keyboard support, comprising a platform for supporting a keyboard; a bracket provided on a predetermined position for locking and fixing the platform by a lock module; a joint module connected to an end of the bracket for adjusting the up/down angle of the platform; a sleeve, a closed end thereof connected to the joint module; a crooked shaft, an end thereof slipped over an opened end of the sleeve for adjusting the waving angle of the platform by rotating the sleeve; and a base connected with an end of the crooked shaft, wherein another end of the crooked shaft is fixed and slipped over an object for adjusting the positions for rotating the crooked shaft.

BRIEF DESCRIPTION OF THE DRAWINGS

It will be understood that the figures are not to scale since the individual layers are too thin and the thickness differences of various layers too great to permit depiction to scale.

DETAILED DESCRIPTION OF THE INVENTION

The structural features and the effects to be achieved may further be understood and appreciated by reference to the presently preferred embodiments together with the detailed description.

Figure 1A:
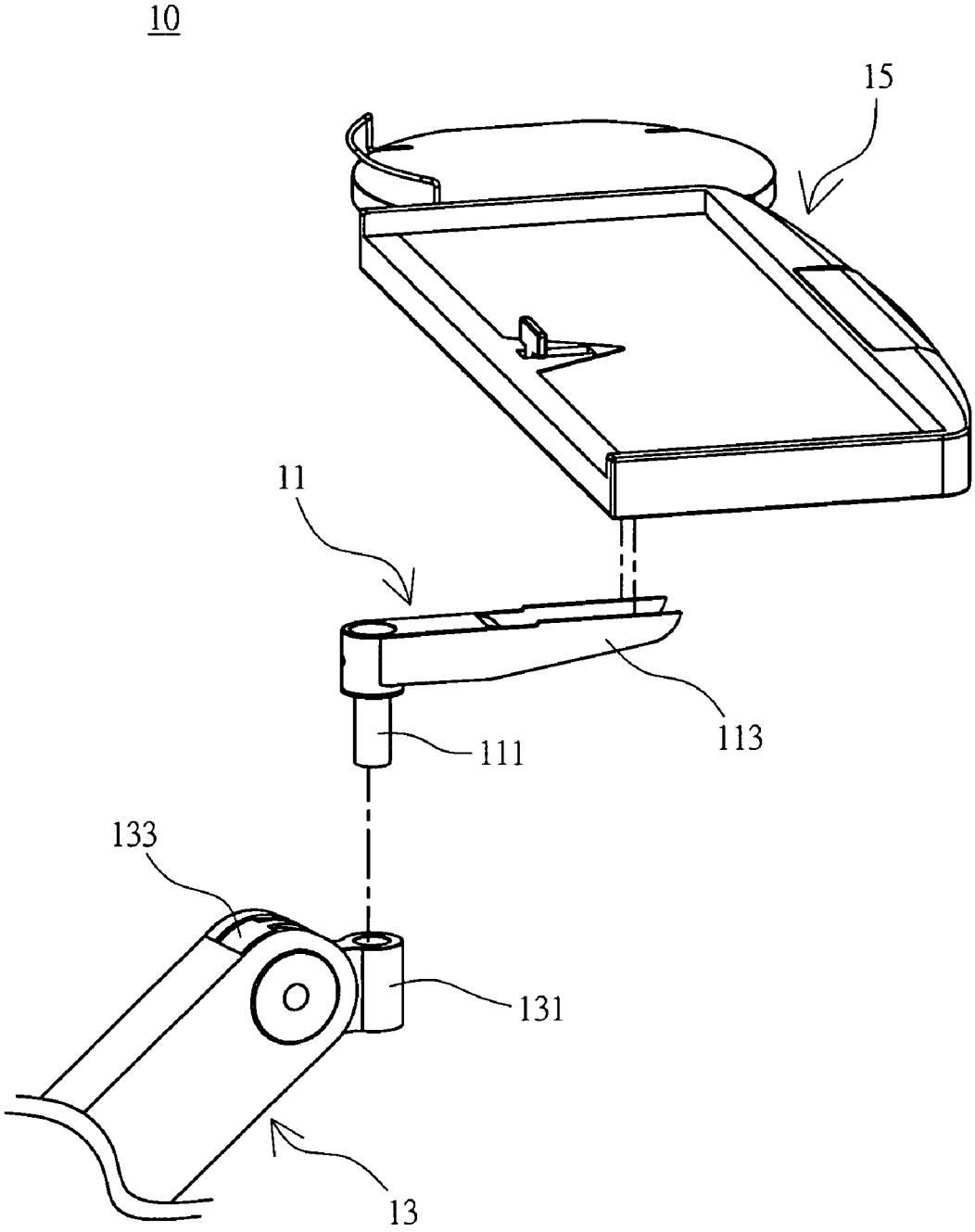
FIG. 1 A (PRIOR ART)
FIG. 1A to FIG. 1C are respectively as three-dimensional views and operation views of a prior art.
Figure 1B:
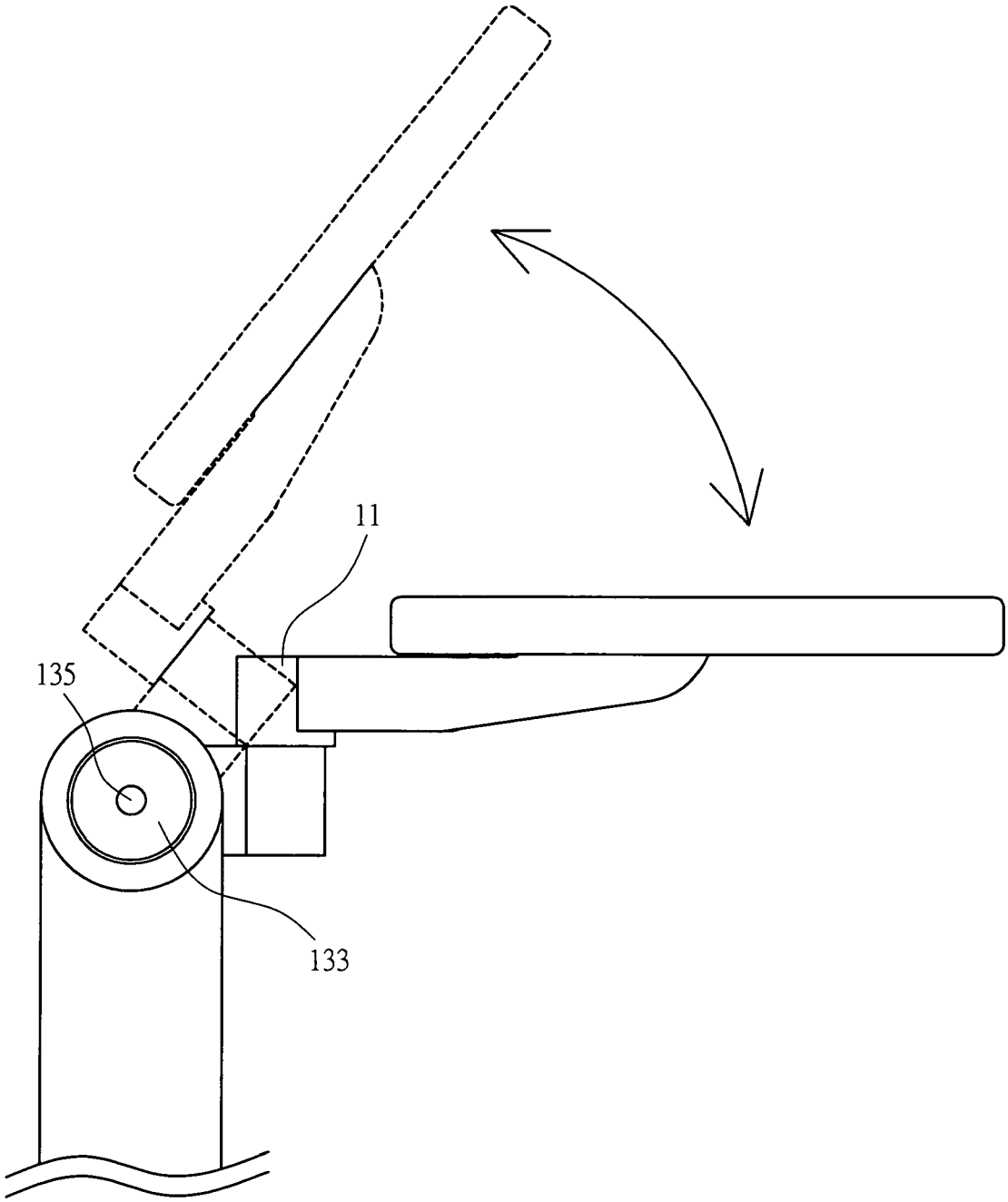
FIG. 1 B (PRIOR ART)
Figure 1C:
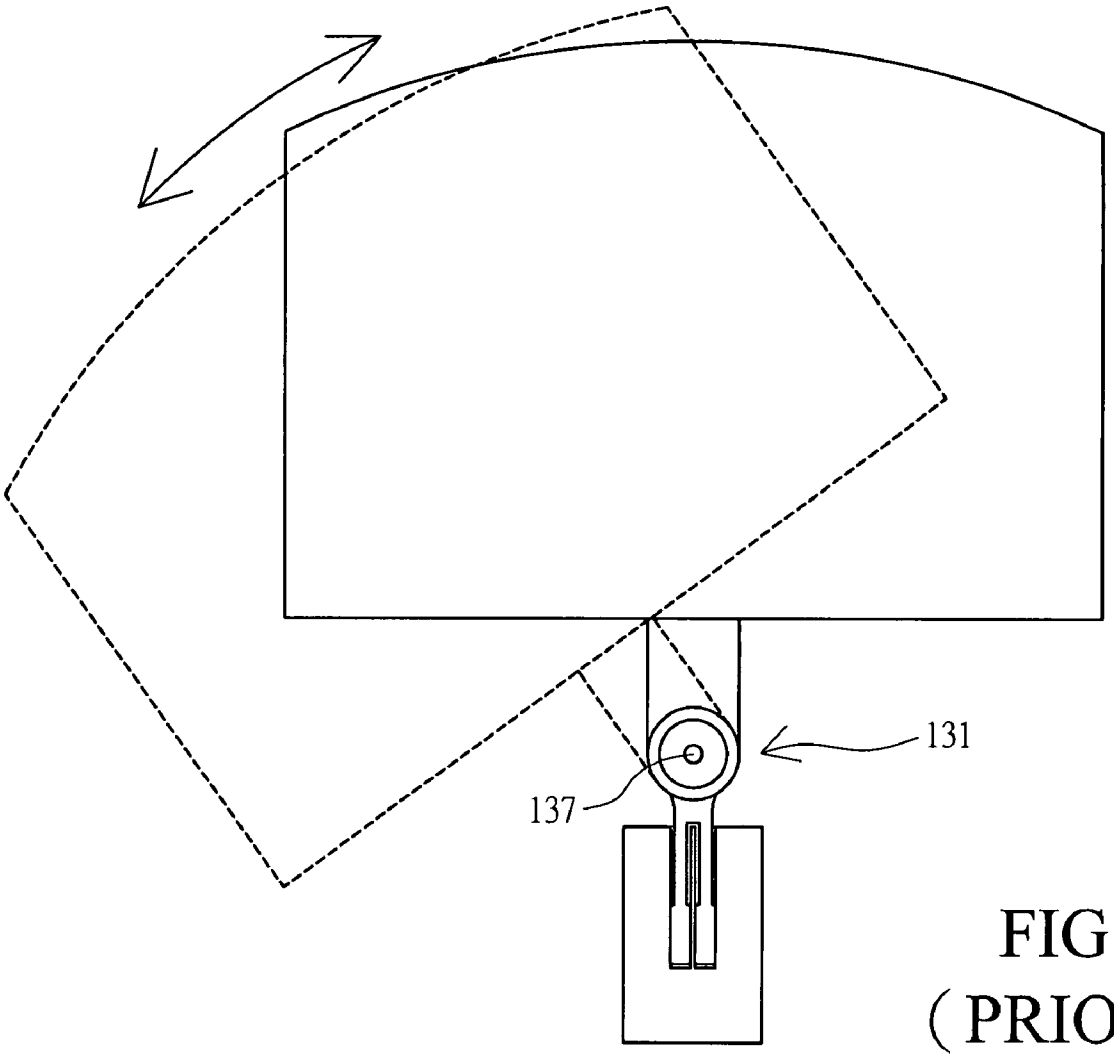
FIG. 1 C (PRIOR ART)
Figure 2:
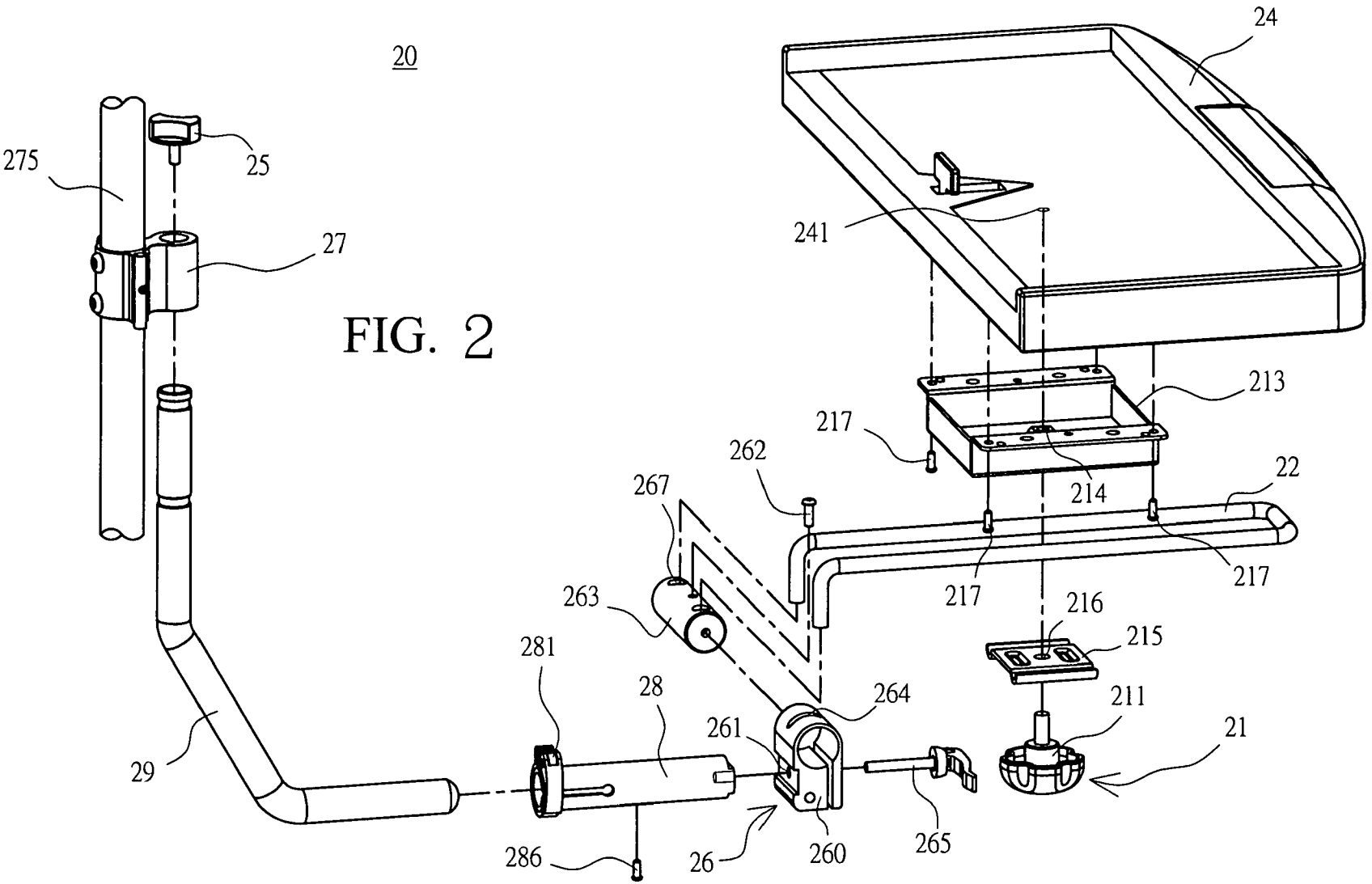
FIG. 2 is a three-dimensional view of a preferred embodiment of the present invention.

Firstly, referring to FIG. 2, is a three-dimensional view of a preferred embodiment of the present invention. The support comprises a platform 24, a bracket 22, a joint module 26, a sleeve 28, a crooked shaft 29, and a base 27. The Base 27 is locked and fixed on an object 275, such as a stationary frame, a suspensory arm, or a table, and further, the base 27 can slip over an end of the crooked shaft 29, such that the crooked shaft 29 can be rotated with free angle for adjusting positions. An opened end of the sleeve 28 can be slipped over another end of the crooked shaft 29, and the closed end thereof can be connected to the joint module 26. The bracket 22 is connected to the joint module 26, and locked the platform 24 fixedly by a lock module 21, thus, the platform can be used for supporting the keyboard.

The joint module 26 can be used for providing the platform 24 to be adjusted in up/down angle. According to the coordination of the crooked shaft 29 and the sleeve 28, the sleeve 28 can be rotated to adjust the waving angle of the platform 24. And, the slipped section of the crooked shaft 29 and the base 27 can be rotated to adjust the positions. Surely, regarding to above mentioned adjustment, the platform 24 can be easily adjusted in any positions and up/down angle for preventing the waving of the platform 24, such that two ends thereof can be with one horizontal, since which is under operation.

The joint module 26 comprises a joint set 260 and a hinge 236, wherein the joint set 260 is connected with the closed end of the sleeve 28, and the hinge 263 is slipped within the joint set 260. One end of the bracket 22 can be linked with the hinge 263 by the connecting hole 267 provided on the hinge 263. The hinge 263 within the joint set 260 can be rotated with the bracket 22 and the platform 24 following for adjusting the up/down angle of the platform 24.

The joint module 26 further comprises a spiral rod 265, which is pierced through the hole 261 of the joint set 260 and locked with the closed end of the sleeve 28. Besides, The strength of locking the spiral rod 265 can be used to clip the hinge 263 after adjusting the angle of joint set 260. The spiral rod 265 can be selected to be as a quick release spiral rod for conveniently releasing and adjusting the angle, and further quickly clipping.

The joint module 26 further comprises a first position limiting member, which comprises a first position limiting hole 264 provided on the predetermined of the joint set 260, and a first position limiting pillar 262 provided on the corresponding position of the hinge 263. The size of the first position limiting hole 264 is used to limit the space of the first position limiting pillar 262 for limiting the up/down angle of the platform 24 within a general used or reasonable adjustment range, such that can prevent the platform 24 falling from the improper adjustment or the accidentally drop. And, the first position limiting pillar 262 can be presented as a screw.

The sleeve 28 is slipped over an end of the crooked shaft 29, which can be as an axis for being rotate to adjust the waving angle of the platform 24, and further, the slipped length of which can be used to adjust the distance between the platform 24 and the base 27. After finishing the adjustment, the opened end of the sleeve 28 can clip the crooked shaft 29 fixedly according to a clipping member 281. The clipping member 281 can be selected to be as a quick release clipper for conveniently releasing and adjusting the angle and distance, and further quickly clipping.

Besides, a second position limiting hole 285 (referring to FIG. 3B) is provided on the predetermined position of the sleeve 28, and a second position limiting pillar 286 is provided on the corresponding position of the crooked shaft 29, such that is as a second position limiting member. The second position limiting member is also with the same function of limiting the space of the first position limiting pillar 286 for limiting the waving angle of the platform 24 and the position adjustment range according to he size of the second position limiting hole 285, such that can prevent the platform 24 falling or the sleeve 28 accidentally dropping. And, the second position limiting pillar 286 can be presented as a screw.

Figure 3A:
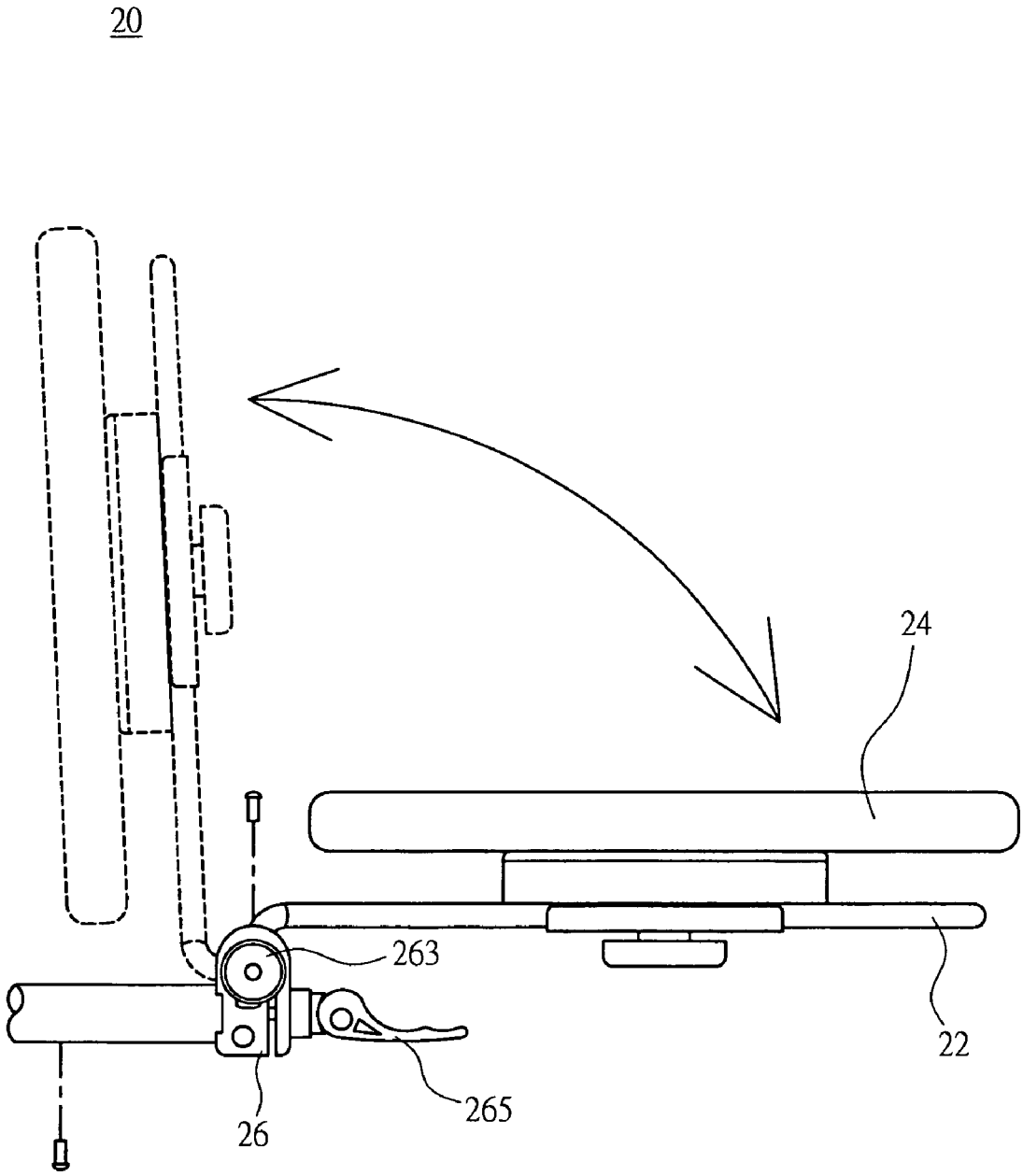
FIG. 3A to FIG. 3D are respectively as operation views of a preferred embodiment of the present invention according to FIG. 2.

The lock module 21 used to link up the bracket 22 and the platform 24 comprises various types. Referring to FIG. 3A, is as an operation view of a preferred embodiment of the present invention according to FIG. 2. When the spiral rod 265 is loosened, the hinge 263 is movable, therefore, the hinge 263 cab be rotated with the bracket 22 and the platform 24 following for adjusting the up/down angle of the platform 24, or providing the adaptable storage angle for the support 20.

Figure 3B:
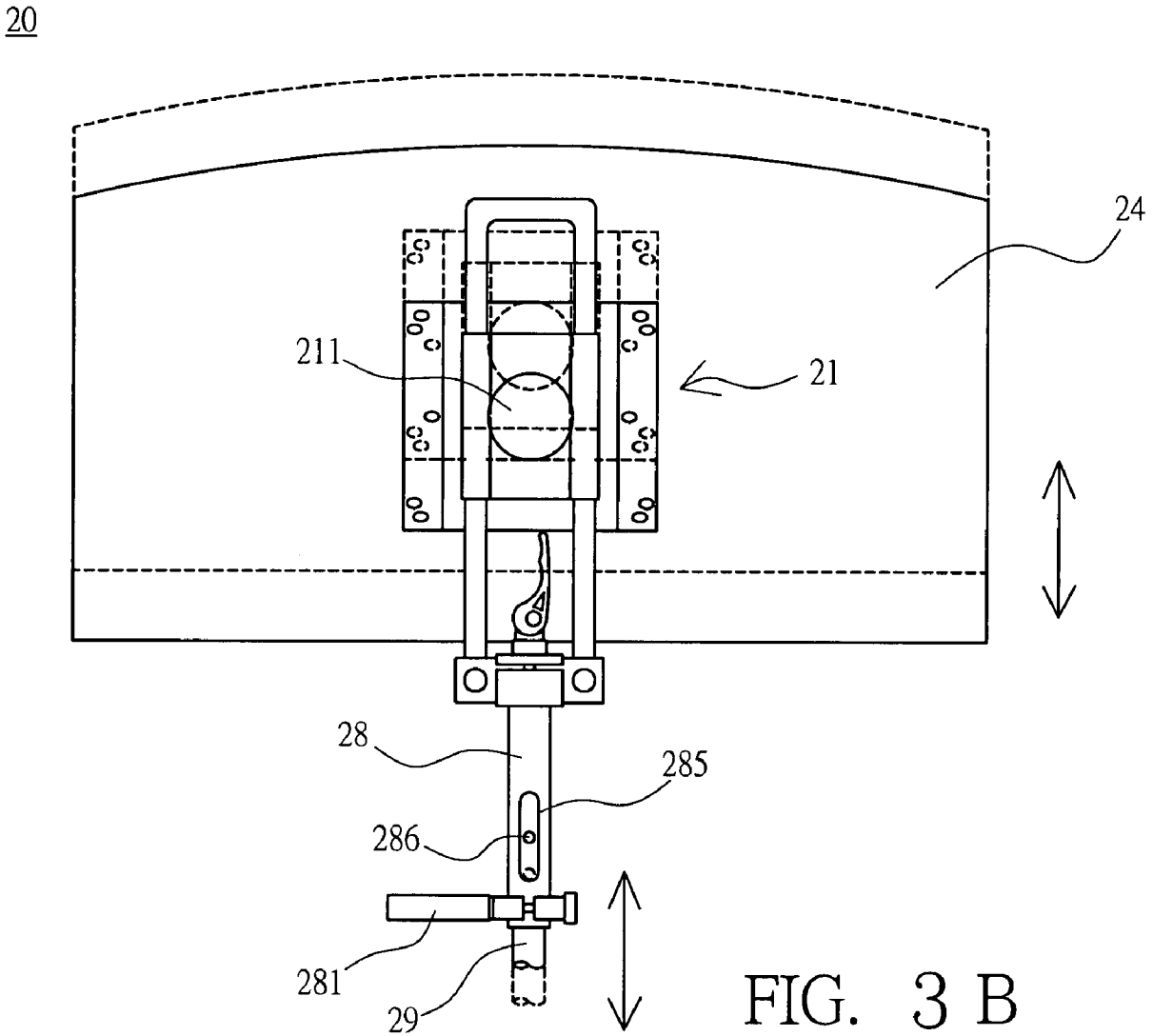
Figure 3C:
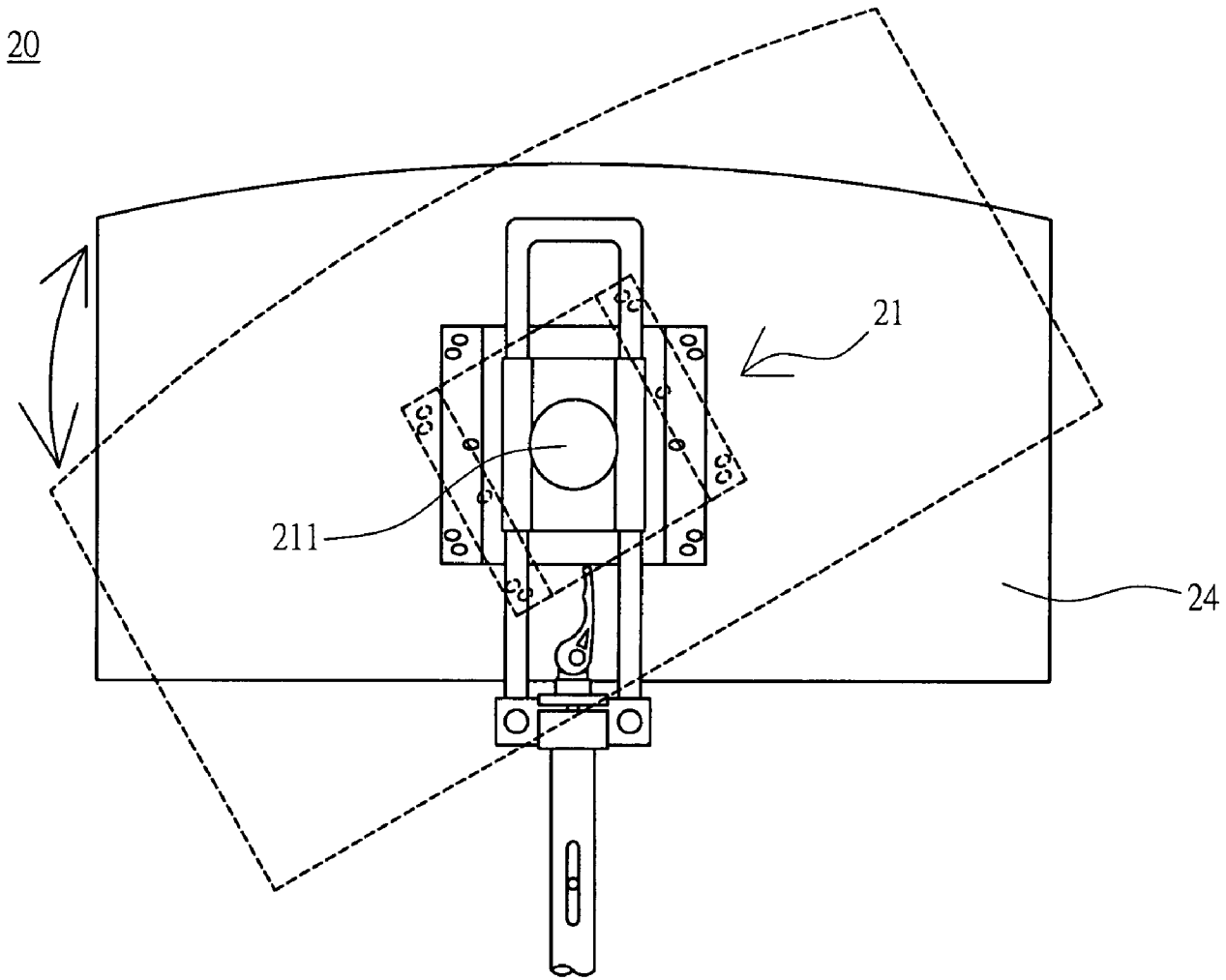

Referring to FIG. 3B and FIG. 3C, are respectively as other operation views of a preferred embodiment of the present invention according to FIG. 2. When the lock spiral rod 211 is loosened, the position of the platform 24 can be adjusted by user, as shown on FIG. 3B, or the angle of which can be adjusted, as shown on FIG. 3C, therefore, the platform 24 can be rotated and shifted, and after finishing the position adjustment, the lock spiral rod 211 has to be fastened. By the way, once the clipping member 281 is released, the sleeve 28 can be shifted in front or rear direction for adjusting the position of the platform 24.

Figure 3D:
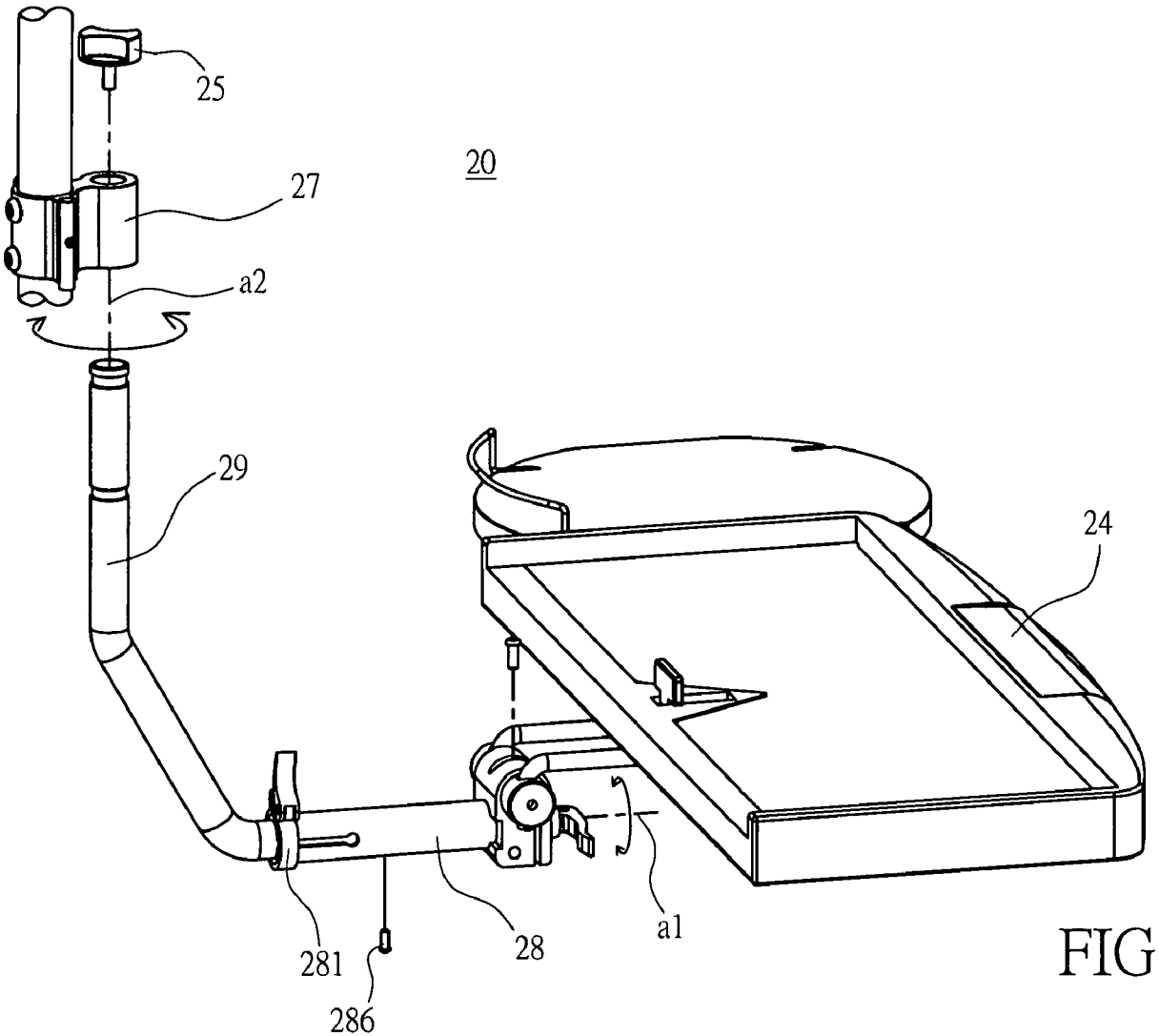

Referring to FIG. 3D, regarding to adjust the waving angle of the platform 24, the clipping member 281 should be to released, the sleeve 28 can be rotated with the platform 24 along the axis (a1) of the crooked shaft 29, and after finishing the angle adjustment, the clipping member 281 has to be clipped, such that can improve the adaptability with respect to the operation of the support 20. During adjusting, the second position limiting hole 285 of the second position limiting member (referring to FIG. 3B) can be used to limit the space of the second position limiting pillar 286 in a reasonable range, such that can prevent the sleeve 28 accidentally dropping from taking off the crooked shaft 29, or prevent the platform 24 turned upside down due to the lager waving.

The crooked shaft 29 can be rotated by user along the axis (a2) of the base 27 for adjusting the position of the support 20 since the crooked shaft 29 and the base 27 are slipped. And the slipped section of which can be locked by a fixer 25 and the crooked shaft 29 for enhancing the linked of the crooked shaft 29 and the base 27.

Figure 3E:
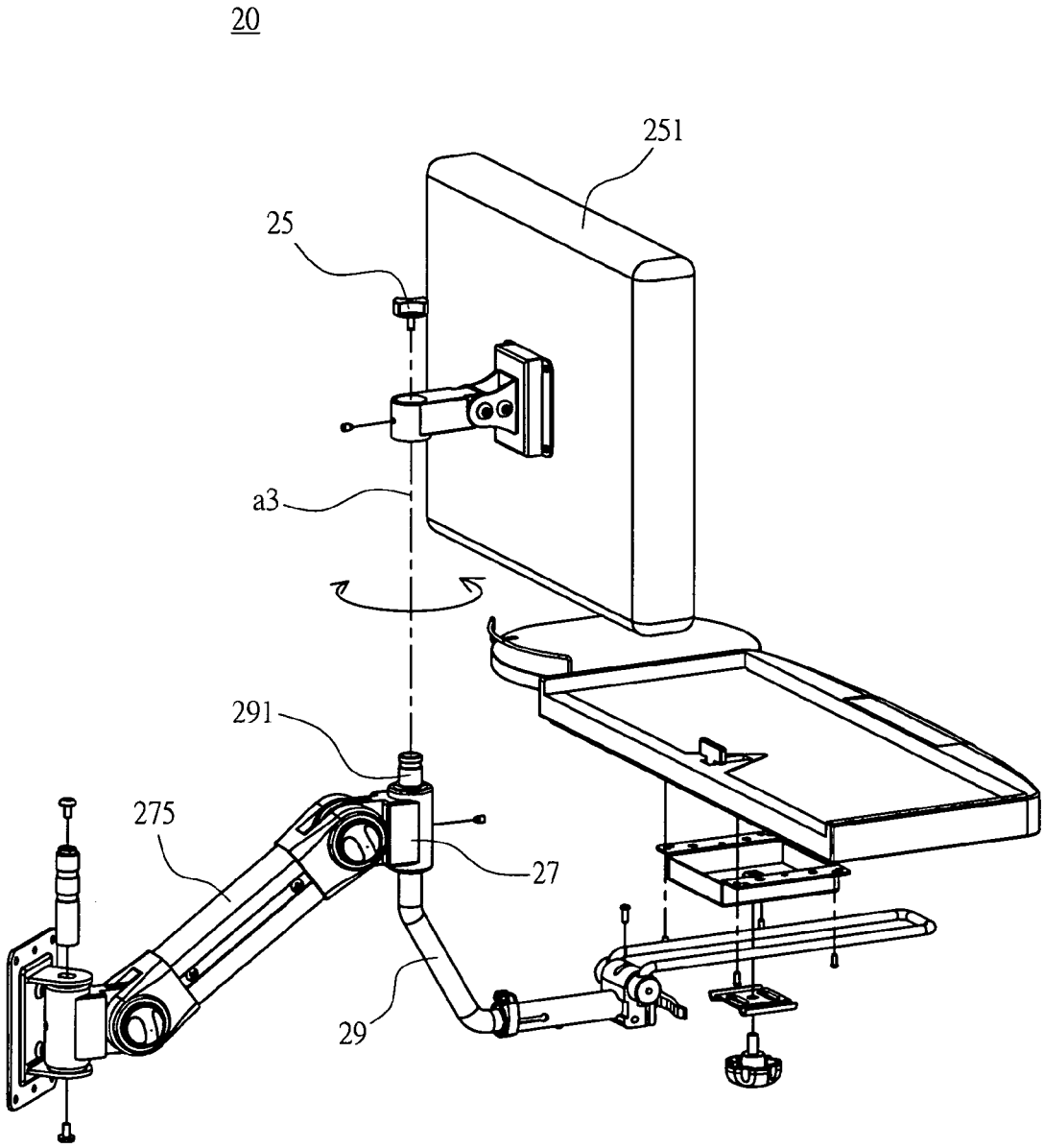
FIG. 3E is a three-dimensional view of another preferred embodiment of the present invention.

Finally, referring to FIG. 3E, is a three-dimensional view of another preferred embodiment of the present invention. An end of the crooked shaft 29 can be pierced through the base 27 with the predetermined length to be as a plug rod 291 for being set with respect to other devices. For example, a screen 251 can be set on the plug rod 291, such that the support 20 can be used to support the keyboard and the screen 251 with following, thus, more convenient operation will be provided for users. Of course, according to the plugging of the screen 251 and the plug rod 291, the screen 251 can be rotated along the axis (a3) of the plug rod 291 for adjusting the direction of that, as well as, more convenient operation is provided for users.

The foregoing description is merely one embodiment of present invention and not considered as restrictive. All equivalent variations and modifications in process, method, feature, and spirit in accordance with the appended claims may be made without in any way from the scope of the invention.

I claim:

1. A keyboard support, comprising:

a platform for supporting a keyboard;

a bracket provided on a predetermined position for locking and fixing said platform by a lock module;

a joint module connected to an end of said bracket for adjusting the up/down angle of said platform;

a sleeve, a closed end thereof connected to said joint module;

a crooked shaft, an end thereof inserted into an opened end of said sleeve for adjusting the waving angle of said platform by rotating said sleeve; and a base connected with an another end of said crooked shaft, wherein another end of said crooked shaft is fixed and inserted into an object for adjusting the positions for rotating said crooked shaft.

2. The support of claim 1, wherein said joint module comprising:

a joint set connected to the closed end of said sleeve; and a hinge slipped into said joint set, connected with said platform for adjusting the up/down angle by rotating.

3. The support of claim 2, wherein said joint module further comprises a spiral rod for linking up said joint member and said sleeve, and clipping said hinge fixedly.

4. The support of claim 3, wherein said spiral rod is as a quick release spiral rod.

5. The support of claim 2, wherein said joint module further comprises a first limiting member, comprising:

a first position limiting hole provided on the predetermined position of said joint set; and a first position limiting pillar provided on the corresponding position of said hinge for limiting the rotating angle of said hinge depending on the size of said first position limiting hole.

6. The support of claim 5, wherein said first position limiting pillar is as a screw.

7. The support of claim 1, further comprising a clipping member for clipping and fixing the opened end of said sleeve and said crooked shaft.

8. The support of claim 7, wherein said clipping member is a quick release clipper.

9. The support of claim 1, wherein said lock module comprises:

a lock set for locking said bracket between said lock set and said platform; and a lock spiral rod, the thread end thereof transpierced said lock set, and locked said lock set, said bracket and said platform fixedly.

10. The support of claim 9, wherein said lock module further comprises a linking set provided on the bottom of said platform for locking said lock spiral rod to further enhance the locking purpose.

11. The support of claim 10, wherein said linking set is fixed on the bottom of said platform by a screw.

12. The support of claim 9, wherein said bracket is as a type of slide guide.

13. The support of claim 1, further comprising a second position limiting member, comprising:

a second position limiting hole provided on the predetermined position of said sleeve; and a second position limiting pillar provided on the corresponding position of said crooked shaft for limiting the rotating angle of said sleeve depending on the size of said second position limiting hole.

14. The support of claim 13, wherein said second position limiting pillar is as a screw.

15. The support of claim 1, wherein said crooked shaft is transpierced and fixed on said base, and an end of said crooked shaft is pierced through said base with predetermined length, said end is as a plug rod.

16. The support of claim 15, wherein said plug rod can be set a screen.

* * * * *